United States Patent [19]

Kurtz et al.

[11] 4,101,126

[45] Jul. 18, 1978

[54] GAME DARTS AND DARTBOARDS EMPLOYING ANTI-BOUNCE-OFF APPARATUS

[75] Inventors: Ronald A. Kurtz, Englewood; Henry P. Utzinger, Ridgewood, both of N.J.

[73] Assignee: Kulite Tungsten Corporation, Ridgefield, N.J.

[21] Appl. No.: 740,211

[22] Filed: Nov. 9, 1976

[51] Int. Cl.[2] ..... F41J 3/00

[52] U.S. Cl. ..... 273/95 R; 273/106.5 B

[58] Field of Search ..... 273/106.5 R, 106.5 B, 273/106.5 A, 95 R

[56] References Cited

U.S. PATENT DOCUMENTS

| | | | |
|---|---|---|---|
| 1,783,303 | 12/1930 | Oberndorfor | 273/106.5 R |
| 2,683,037 | 7/1954 | Ruczynski et al. | 273/106.5 A |
| 3,976,298 | 8/1976 | Hiuchman | 273/106.5 R |
| 4,057,251 | 11/1977 | Jones et al. | 273/102 B |

FOREIGN PATENT DOCUMENTS

| | | | |
|---|---|---|---|
| 521,630 | 5/1940 | United Kingdom | 273/106.5 R |
| 788,356 | 1/1958 | United Kingdom | 273/106.5 A |

*Primary Examiner*—Richard C. Pinkham
*Assistant Examiner*—Lawrence E. Anderson
*Attorney, Agent, or Firm*—Arthur L. Plevy

[57] ABSTRACT

There is disclosed a game dart having a pivotally moveable point which is coupled to the barrel section of a dart within an aperture located in the barrel section and of a diameter larger than the diameter of the dart point section. The space between the aperture and the dart point section contains an elastomeric material permitting the point to flex or pivot upon striking a metal rib associated with a dartboard. Other embodiments depict a flexible point section which due to its construction, will flex or pivot; while other embodiments depict techniques for coupling the point section to the barrel to allow flexing of the dart point when contacting a metal rib.

Another apparatus which circumvents the bounce-off problem depicts a dartboard employing special cross-sectional metal ribs to provide a sliding surface for the dart when the pointed end contacts the rib.

7 Claims, 9 Drawing Figures

GAME DARTS AND DARTBOARDS EMPLOYING ANTI-BOUNCE-OFF APPARATUS

BACKGROUND OF THE INVENTION

This invention relates to darts and dartboards such as those used in games of skill and more particularly to darts and boards which employ anti-bounce-off apparatus.

The game of darts is played throughout the world as a competitive contest. Many players are quite skilled in throwing a dart at a designated or desired location on a dartboard. The dartboards employed by serious players of the game incorporate a plurality of metal ribs to define target patterns for the board; and many games of darts require the participants to hit within predetermined target areas whose boundaries are defined by the metal ribs. As such, the ribs are fabricated from steel wire of a diameter between one or two or more millimeters. As will be described, the total area covered by these ribs is a reasonable portion of the board area. Hence, players often times hit a metal rib with the dart point. This causes the dart to bounce off the board and hence, the player receives no score. It is also determined that the better the player is, the more bounce-off he will experience due to the object and formats of various dart contests or games.

It is therefore an object of the present invention to provide a dart with a flexible or pivotal point which serves to reduce bounce-off. A further object is to provide a dartboard employing special metallic cross-sectional ribs to permit a dart impinging upon the rib to be deflected towards the board to thereby also reduce bounce-off.

BRIEF DESCRIPTION OF PREFERRED EMBODIMENT

A game dart of the type including a point section coupled to one end of a barrel portion and a flight assembly coupled to the barrel portion at the other end to enable the dart to be aimed and thrown at a target, the improvement comprising a pivotable point section coupled to said barrel portion and capable of pivoting with respect to the barrel portion when said point impinges upon a metal rib material associated with said target.

DETAILED DESCRIPTION OF FIGURES

Figure 1:
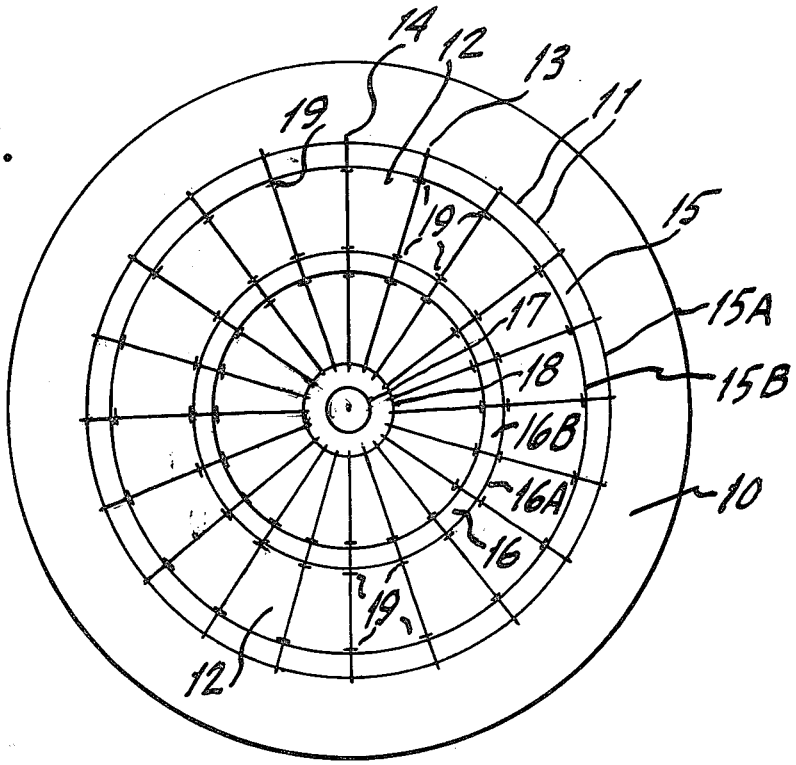
FIG. 1 is a front plan view of a typical dartboard.

Referring to FIG. 1, there is shown a typical tournament type of dartboard 10. Such boards as 10 are constructed from a penetrable material such as jute, cork and so on to permit a pointed dart to enter the board and be held in place by the board material. The operation of a dart and dartboard is considered to be well known. The dartboard 10 is usually about forty or more centimeters in diameter and has a plurality of metal ribs 11 defining target patterns.

Essentially, the board 10 contains twenty equal pie-shaped areas as 12. Each area as 12 is bounded by two radial metal ribs as 13 and 14. Each rib 13 and 14 is approximately 1 to 2 or more millimeters in diameter and is fabricated from a steel wire of a circular cross-section. An outer ring area 15 is located about sixteen centimeters from the center of the board. The outer ring area 15 is defined by an outermost metal rib **15*a* and an inner rib 15*b*. The distance between the ribs 15*a* and 15*b*** is approximately one centimeter.

An inner ring area 16 is located about ten centimeters from the center and is defined by an outer ring **16*a* and an inner ring 16*b*. The distance between the rings 16*a* and 16*b* or the inner area 16** between the rings is also about one centimeter.

There is a central bulls-eye area 17 and a concentric area 18. Area 17 is about one and a half centimeters in diameter with area 18 about three and a half centimeters in diameter. The entire metal grid is held in place on the board 10 by a series of staples as 19 which are of the same material as the wire grids. It is thus indicated that in a board as 10, the entire grid depicted is formed by steel wire of approximately 1 to 2 millimeters in diameter and of a circular cross-section.

As can be ascertained, the wire grid depicted covers a reasonable portion of the board 10. If a player, upon throwing a conventional dart, strikes a metal grid wire 11, the dart bounces off and does not secure itself in the board 10. For the bounce-off the player receives no score. Furthermore, the point of the dart may be damaged by striking the metal grid wires.

Figure 2:
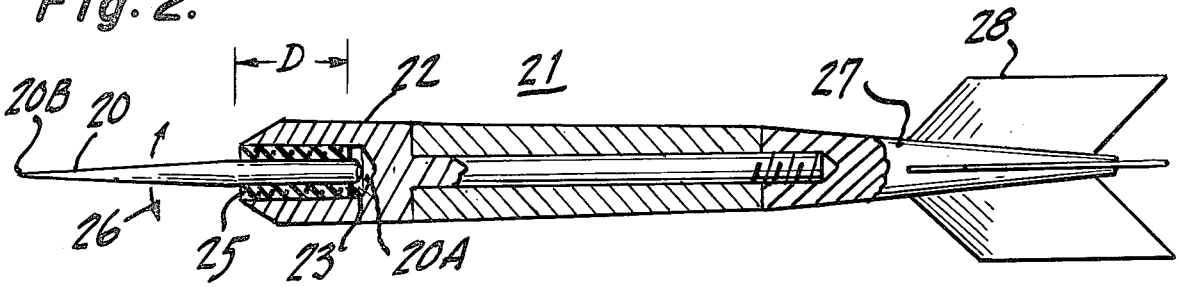
FIG. 2 is a side cross-sectional view of a game dart according to this invention.

FIG. 2 depicts a dart having a pivotable or radially moveable point section or portion 10. The point section 20 of the dart is fabricated from stainless steel or a similar material. The point portion 20 is inserted into an aperture 23 in the barrel portion 21 of the dart. It is understood that the dart sections as 20,21 and 27 are circular in cross-section as is conventional. The aperture 23 is of a larger diameter than the thickest section of the point portion 20. The end 20A of the point portion is not secured to the barrel portion, but is held within the aperture 23 by means of a surrounding elastomeric sleeve 25. The sleeve 25 thus encircles the point portion 20 for a given distance D within the aperture 23. The space between the point portion and the aperture is filled with an elastomeric material 25, such as a rubber, a soft plastic or some other resilient and flexible material. Hence, as can be ascertained, the point 20 can flex or pivot in the direction of the arrow 26 for a full 360°. The amount of movement of the point 20 or the tip of the point 20B is determined by the diameter of aperture 23 and the elasticity of the elastomeric material 25 within the aperture 23. Hence, the extended point portion is not rigidly mounted, but is free to flex or move, as will be explained to reduce bounce-off from the dartboard. Conventionally, the barrel portion 22 is coupled to a flight section 27 which holds the flight elements 28 of the dart. The point portion 20 has a tip or a pointed end 20B which tapers to a uniform diameter at the barrel end 20A.

Figure 3:
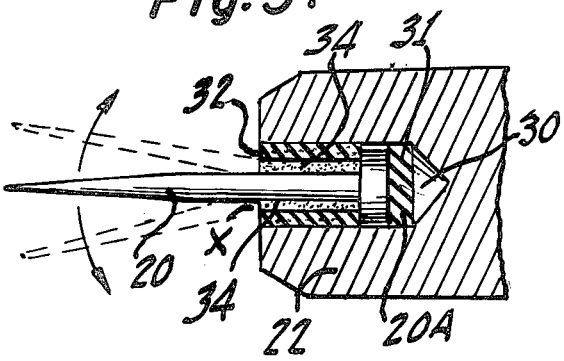
FIG. 3 is a partial cross-sectional view of a dart point portion and a barrel coupled together, according to one embodiment of this invention.

Referring to FIG. 3, there is shown an alternate coupling technique for a point portion 20 (partial view) coupled to a barrel section 22 (partial). An aperture 30 is of a larger diameter than the point portion 20. The point 20 has a flanged head end 20A and appears as a conventional type of carpenter nail, with a flat head 20A and a point section 20B. The point section 20 is secured within the aperture 30 by means of a press fitted sleeve 32. Sleeve 32 coacts with an elastomeric sleeve or material 34 which is positioned between the point portion 20 and the metal sleeve 32. Behind the flat head of the point section is a piece of elastomeric material 31 to allow the point 20 to flex and pivot. As can be seen, the point 20 can pivot or move in the direction of the arrows and the motion or movement is limited by the distance X between the wall of the metal sleeve 32 and the adjacent surface of the point portion 20. A dashed line drawing depicts the nature of the movement or flexing of the point portion due to the mounting technique depicted. It is noted that the space X is filled in with an elastomeric material, such as sleeve 34. There is a spacing between the edges of the flat end 20A and the aperture 30 to allow for the pivoting or flexing action.

Figure 4:
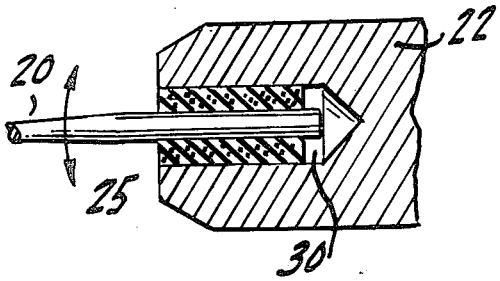
FIG. 4 is a partial cross-sectional view of a dart point and barrel assembly according to an alternate embodiment.

FIG. 4 shows the barrel portion aperture 30 of a larger diameter than the point portion 20. Included within the aperture 30 and surrounding and coupling the point portion 20 to the barrel is an elastomeric sleeve 25 which can be glued or epoxied within the aperture 30 of the barrel 22. This sleeve permits the pivoting movement shown by the arrows to permit the point to move or flex when contacting a metal rib. The elastomeric material 25 may also be poured in the aperture and allowed to harden to thereby secure the point 20 as shown.

Figure 5:
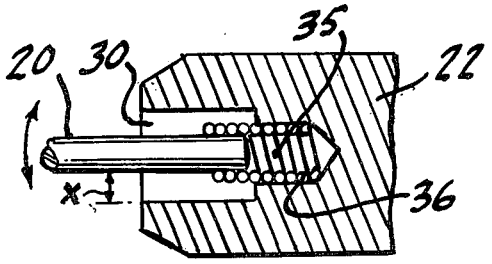
FIG. 5 is a partial cross-sectional view of a point and barrel assembly according to a further embodiment.

FIG. 5 shows a barrel portion 22 having a first aperture 30 selected to provide a given amount of pivotal motion for the point 20. The distance X between the surface of the point 20 and the edge of the aperture 30 is selected to accommodate the maximum movement desired, as will be explained in conjunction with FIG. 7. A strong spring 35 is welded to the barrel portion and is, as shown, contained for a portion of its length in an aperture 36 coaxial and communicating with aperture 30. The point 20 is coupled as welded, soldered or epoxied to the spring. The spring 35 exhibits little motion for vertical forces, but can pivot to again cause the point 20 as coupled thereto, to move radially as indicated and as limited by the diameter of the aperture 30. A spring as 35 employs tightly spaced coils to thereby achieve lateral or pivotal movement with little vertical movement.

Figure 6:
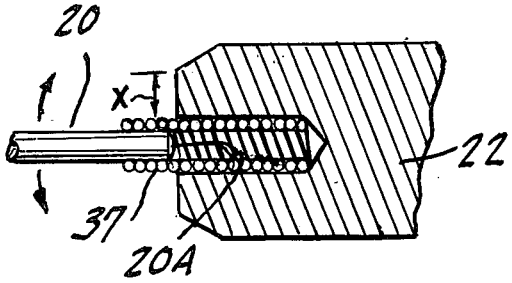
FIG. 6 is a partial cross-sectional view of an alternate embodiment of a point and barrel assembly.

In FIG. 6, there is shown a point 20 rigidly secured to a spring 37 by means of a weld, epoxy or some other strong and reliable bonding agent. In this embodiment, the point 20 does not extend into aperture 30, but the end 20A is secured to the spring 37 near the front opening to allow greater flexibility and pivotal motion. In this manner, the point 20 is not limited in pivotal motion by the diameter of the aperture 30, but such motion is controlled by the characteristics of the spring 37.

Figure 7A:
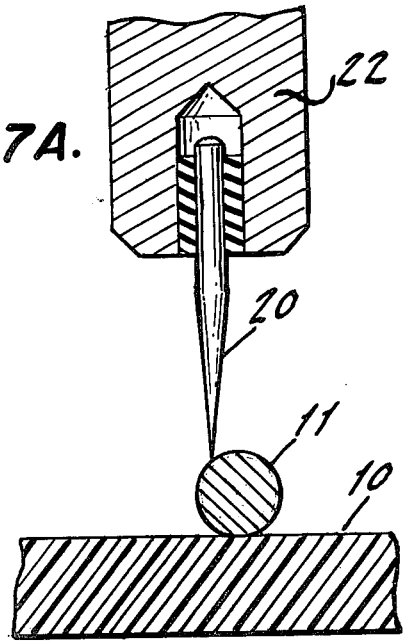
FIGS. 7A and 7B are cross-sectional views helpful in explaining the operation of the invention.
Figure 7B:
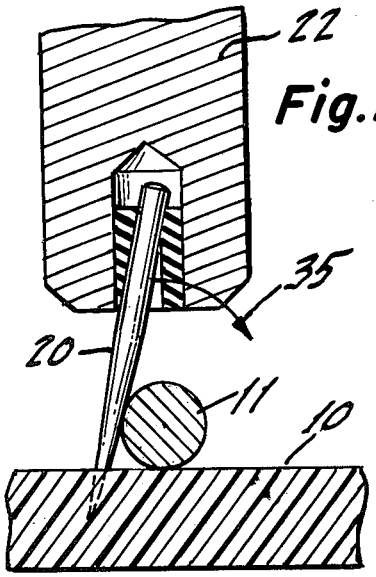

The desired action is shown in FIGS. 7A and 7B. As previously indicated, a dartboard 10 has a series of metal circular grid wires as 11 located on the surface and used to define target areas. FIG. 7A shows a dart point 20 about to contact the circular steel wire 11. The dart point 20 is coupled to a barrel 22 as shown in FIGS. 2 to 6. In the prior art, the point 20 is rigidly coupled to the barrel 21 and would, upon hitting the wire 11, bounce off and fall from the target or board 10. In employing the darts shown in FIGS. 2 to 6, the point 20 would flex and move due to the coupling to the barrel 22. As in FIG. 7B, the dart point 20 pivots about the wire 11 and the point end is directed into the board material due to the flexing of the point portion 20 with respect to the barrel. As shown, the barrel moves along arrow 35 to a rest position so that the final position assures that the barrel is again aligned properly with the point 20. Hence, the flexing or pivoting of the point assures that the dart will impinge upon the board and not bounce off as readily as darts employed in the prior art.

Since the diameter of the wire 11 is about one to two millimeters, the distance X is selected accordingly to thus permit the point to move or pivot at least one-half the diameter of the wire in all directions about the wire 11. The distance X assures that the point can move with respect to the barrel. If the area between the point surface and the aperture is filled with an elastomeric material, the compression of the material will also control the distance the point tip of the dart can pivot or move. In FIG. 6, the motion is controlled by the characteristics of the spring 37.

Thus, a number of configurations have been depicted which permit a point portion of a dart to slide or move over a metal wire associated with a dartboard to thus provide an antibounce dart configuration. While other configurations and coupling schemes are possible, aspects and utility of the apparatus and the solution to the problem have been indicated in the above figures.

Figure 8:
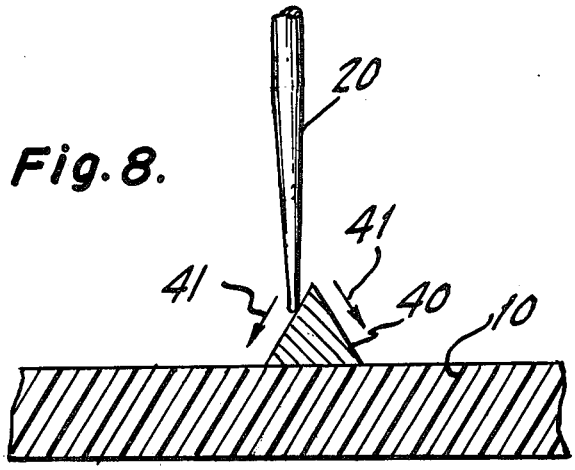
FIG. 8 is a cross-sectional view of a special rib cross-section used on a dartboard according to this invention.

To further guard against dart bounce, FIG. 8 shows a dartboard having a triangular cross-section wire 40 employed to formulate the grid structure as shown in FIG. 1. The wire 40 may have a cross-section of an equilaterial triangular configuration, wherein each side is approximately 1 to 2 millimeters or relatively equal to the diameter of prior art circular grid wires as 11. As the point end 20 of a dart impinges upon the wire, the sloped surfaces depending from the apex 46, cause the point to be directed along arrow 41 and hence, impinge upon the target 10. The dart configurations as depicted in FIGS 2 through 6 further facilitate this action and hence, the combination of such grid wires as 40 and such darts depicted will serve to alleviate the bounce-off problem to a greater degree.

It is understood that a triangular cross-section wire as 40 provides a sloped control of direction for the point portion 20 and other cross-sectional configurations could be employed as well such as different triangular cross-sections, as isoceles triangles and so on.

If is of course, understood that the grid wires on such boards are selected in diameter (one to two or more millimeters) to render them visible and easy to view so a participant can aim and properly direct the dart. While one may envision grid structures formed from a penetrable material as plastic and so on, it is understood that these materials will be cut and severed by the dart besides being difficult to secure to the board and so on.

It is also understood that one may employ a flexible point material which is epoxied or glued directly within an aperture as 30 in the panel 22. Thus a point 20 may be fabricated from a strong material as nylon, fiberglass, an epoxy resin or a plastic. Such a point material will allow the point itself to pivot or flex within controlled limits to provide an antibounce dart assembly according to the flexibility of the dart point material.

It is understood that changes may be made in the construction of the apparatus without departing from the spirit and scope of the claims appended hereto and all such modifications are deemed to be encompassed within the spirit and scope of the claims presented.

We claim:

1. A game dart of the type employing a point portion coupled to a barrel porton, said barrel portion including a flight section for enabling said dart to be thrown and aimed at a target, said target characterized by including a plurality of grid wires, which are relatively impenetrable by said dart point portion, the improvement therewith of apparatus for coupling said point portion to said barrel portion, comprising:

a barrel portion having a central extending aperture of a given diameter, a point portion having a point tip at one end and tapering to a fixed diameter at said other end and secured to said barrel portion at said other end with a length of said other end surrounded by said aperture to permit said point end to pivot in all directions by a given amount according to the diameter of said aperture and said diameter selected in accordance with the width of said grid wires so that the spacing between said point portion and said aperture is sufficient to permit said point tip to move a distance at least half of the width of one of said grid wires.

2. The dart according to claim 1 further comprising an elastomeric material located within said aperture of said barrel and surrounding said length of said other end of said point portion to permit said point end to pivot.

3. The dart according to claim 1 wherein said other end of said point portion is coupled to said barrel by means of a spring having a tightly wound coil configuration, with said spring rigidly secured to said barrel portion at one end and encircling and secured to said other end of said point portion to allow said point portion to flex with respect to said barrel.

4. The dart according to claim 1 wherein said other end of said point portion is encircled by an elastomeric annular member located within said barrel portion to permit said point end to flex with respect to said barrel portion.

5. A game dart of the type adapted to be thrown at a target of the type including a plurality of grid wires which are relatively impenentrable by a point portion associated with a game dart, the improvement therewith of apparatus for coupling said point portion to said barrel portion, comprising:

a. a cylindrical barrel portion having a point accommodating end and a flight accommodating end, with a coaxial aperture beginning at said point accommodating end and of a given length and diameter, b. a point portion having a tip end which tapers into a second end of a relatively fixed diameter, said diameter being relatively less than the diameter of said aperture, means coupling said second end to said barrel within said aperture whereby said surface of said point portion as extending within the length of said aperture is separated perpendicular to the axis from said barrel portion by a given distance to thereby permit said tip to pivot or flex according to said separation, said separation selected in accordance with the width of said grid wires to enable said point and therefore said dart to be directed from a wire towards said target when pivoted by said wire, with said separation as provided enabling said point tip to move a distance at least half the width of one of said grid wires.

6. The game dart according to claim 5 further comprising an elastomeric material located between the surface of said point portion and said barrel portion for encircling said point portion to further control the flexing of said point tip.

7. The game dart according to claim 5 wherein said second end of said point section is coupled to a spring member at one end and said spring member coupled to said barrel section within said aperture at said other end.

* * * * *